United States Patent [19]

Brown

[11] 4,158,924

[45] Jun. 26, 1979

[54] TOOTH ARRANGEMENT FOR ROTARY TRENCHER

[75] Inventor: Stanley L. Brown, Lenox, Iowa

[73] Assignee: Roscoe Brown Corporation, Lenox, Iowa

[21] Appl. No.: 872,967

[22] Filed: Jan. 16, 1978

Related U.S. Application Data

[62] Division of Ser. No. 772,558, Feb. 28, 1977, Pat. No. 4,110,920.

[51] Int. Cl.[2] ..... E02F 9/28; E02F 5/08

[52] U.S. Cl. ..... 37/97; 37/141 T; 37/191 A

[58] Field of Search ..... 37/91, 86, 191 A, 97, 37/141 T, 141 R, 192 A, 94

[56] References Cited

U.S. PATENT DOCUMENTS

| | | | |
|---|---|---|---|
| 1,745,090 | 1/1930 | Geithle | 37/191 A |
| 2,519,076 | 8/1950 | Schmidt | 37/191 A |
| 3,054,198 | 9/1962 | George et al. | 37/86 |
| 3,104,481 | 9/1963 | George et al. | 37/191 A |
| 3,131,492 | 5/1964 | Speicher et al. | 37/94 |
| 3,611,730 | 10/1971 | Brettrager | 37/94 X |
| 3,932,951 | 1/1976 | Scott et al. | 37/86 |

*Primary Examiner*—Clifford D. Crowder
*Attorney, Agent, or Firm*—Zarley, McKee, Thomte, Voorhees & Sease

[57] ABSTRACT

The trenching machine of the present invention comprises a support frame, a continuous member either of the wheel or chain type having a plurality of excavating members mounted thereon, mounting means retentively movably mounting the continuous member to the frame, for movement of the excavating members in a continuous path, the mounting means comprising at least two rotatable wheels mounted to said frame for rotation and positioned as to engage the continuous member for rotatable retentive engagement therewith, at least one of the wheels being movable toward and away from the other of the wheels, and power means for moving the movable wheel away from the other wheel so that the wheels may be adjusted to take up the slack between them and the continuous member. The excavating members are of semi-circular construction, some of the members facing in one direction and the other of the members facing in the opposite direction so that each excavating member excavates approximately half of the trench. A shoe assembly is mounted rearwardly of the excavating members and includes a pair of spaced apart shoe casing plates which are flexible adjacent their rearward ends so as to conform to the trench even when the trenching device turns to cut a curved trench. An elongated shoe is mounted to the shoe assembly adjacent the lower end thereof and includes power means connected thereto for causing pivotal movement of the shoe about a horizontal axis so as to permit selective pivotal adjustment of the attitude of the shoe.

1 Claim, 9 Drawing Figures

TOOTH ARRANGEMENT FOR ROTARY TRENCHER

This is a division of application Ser. No. 772,558, filed Feb. 28, 1977 now U.S. Pat. No. 4,110,920.

BACKGROUND OF THE INVENTION

This invention relates to trenching machines of both the wheel or the chain type.

The drawings illustrate a trenching machine of the wheel type which includes a pair of spaced apart circular rims mounted for rotational movement and including at their outer peripheral edges a plurality of excavating members for engaging the ground and excavating a trench. Certain problems have been encountered with trenching devices presently being used.

One problem pertains to the mounting of the circular rims for rotation. This is usually done by means of three wheels or dollies which rotatably engage the inner margins of the rims. Throughout extensive use of the trenching machine the inner margins of the rims begin to wear, and eventually there is substantial slack between the wheels and the rims Taking up of this slack is a cumbersome task.

Another problem encountered with present devices pertains to the excavating members which are on the outer peripheral edge of the rims. These excavating members in presently known devices are of the same cross-sectional shape as the bottom of the trench to be excavated. Because each excavating member is the same shape as the bottom of the trench, there is considerable friction and resistance encountered during the excavating process. Furthermore, when the excavating member reaches the top of the circle, there is a scraping member which scrapes the material from the excavating member and permits it to fall to a conveyor to be carried away. With presently known excavating members considerable resistance is encountered between the scraping member and the excavating members, thereby causing wear and tear on the machine parts.

Another problem encountered with present excavating devices pertains to the shoe assembly which is mounted rearwardly of the excavating wheel. The shoe assemblies generally include two spaced apart parallel plates adapted to follow behind the wheel and to engage the lateral sides of the trench rearwardly of the wheel. These plates must be sufficiently rigid to provide reinforcement of the lateral walls of the trench immediately behind the wheel, but at the same time, they must be sufficiently flexible to permit the wheel to change directions as it is excavating the trench.

Another problem with the shoe assembly of the present devices pertains to the elongated shoe which is approximately horizontally disposed and which follows along on the bottom of the trench immediately behind the wheel. The horizontal attitude of this shoe must be adjusted slightly depending upon the particular soil configuration which is being excavated. Adjusting the attitude of this shoe has heretofore been a time-consuming and complicated problem.

SUMMARY OF THE INVENTION

The present invention provides solution to many of the above mentioned problems. One feature of the invention includes a movable dolly wheel which may be adjusted radially outwardly to take up the slack occurring between the dollies and the rotating rims as a result of rim wear. The movable dolly is mounted at the apex of two elongated members which in turn are pivotally mounted to the support structure of the machine. One of these elongated members is telescopically longitudinally extendible so as to force the dolly wheel radially outwardly against the inner margins of the rims. A hydraulic cylinder actuates the telescopic movement of this member.

Another feature of the present invention includes the configuration of the excavating members. Each excavating member is shaped to excavate approximately half of the cross-sectional configuration of the trench. Half of the excavating members face in one direction and the other half of the excavating members face in the opposite direction. Because each excavating member cuts only half of the trench, the resistance encountered during the excavating action is substantially less. Furthermore, when each excavating member is scraped clean at the top of the wheel, there is substantially less resistance between the scraping blade and the excavating members. Furthermore, the soil has an unobstructed area through which to eject after having been scraped out of the bucket, and may then fall unobstructed to the conveyor belt or discharge chute.

Another feature of the invention includes the use of a shoe assembly having a pair of spaced apart plates mounted rigidly at the forward ends thereof to a vertical shoe post. The plates extend rearwardly from the shoe post and are inter-connected by a plurality of cross members pivotally mounted to each plate for pivotal movement about a vertical axis. The result of this configuration is that the plates are laterally flexible adjacent their rearward ends so as to permit the wheel to change directions as it is excavating the trench.

Another feature of the present invention relates to the use of a shoe mounted at the lower end of a vertical post in the shoe assembly. The shoe is mounted about a horizontal axis and includes hydraulic power means for adjusting the horizontal attitude of the shoe about the horizontal axis. The attitude of the shoe may be adjusted to accommodate soil of varying configuration merely by actuating the hydraulic cylinder.

Therefore a primary object of the present invention is the provision of a new and useful excavating device. A further object of the present invention is the provision of a trenching device which includes means for taking up the slack between the rotating wheels or dollies and the interior margins of the rims.

A further object of the present invention is the provision of a trenching device wherein the aforementioned slack between the wheels or dollies and the rotating rims may be quickly and easily taken up to overcome wear which occurs on the interior margins of the rims.

A further object of the present invention is the provision of a trenching machine having excavating blades which may be cleaned easily and substantially reduce the resistance encountered during excavating and cleaning.

A further object of the present invention is the provision of a trenching machine having a shoe assembly which is laterally flexible so as to permit the trenching machine to change directions as it is excavating the trench.

A further object of the present invention is the provision of a trenching machine having a laterally flexible shoe assembly which has sufficient resiliancy to return to its original position after being deflected laterally.

A further object of the present invention is the provision of a trenching machine which includes a horizontally disposed shoe which may be adjusted about a horizontal axis to vary the horizontal disposition thereof so as to accommodate soils of varying configurations.

DETAILED DESCRIPTION OF THE DRAWINGS

Figure 1:
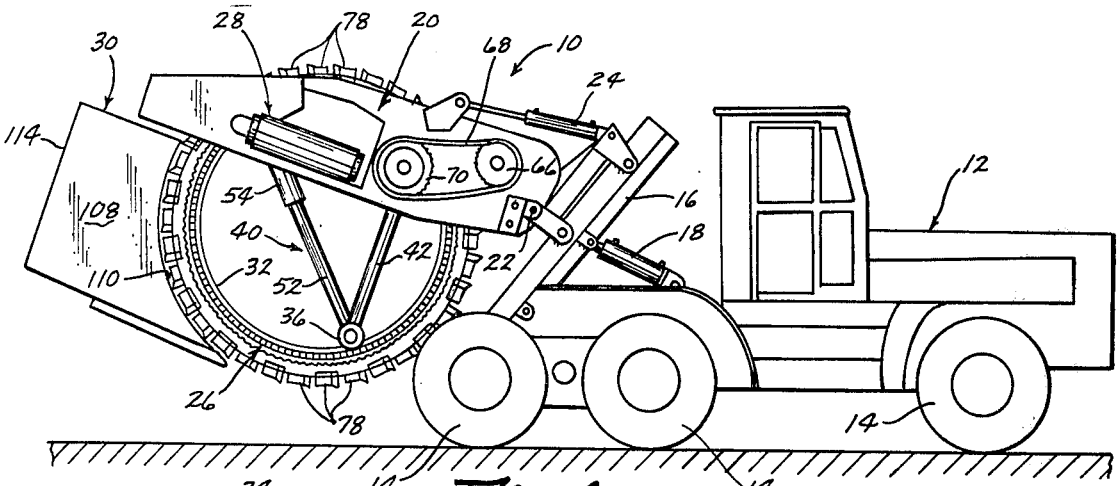
FIG. 1 is an elevational view of the trenching machine of the present invention.

Referring to FIG. 1, the numeral 10 generally designates the trenching machine of the present invention. Trenching machine 10 includes a vehicle 12 supported by wheels 14. Pivotally mounted about a horizontal axis adjacent the rearward end of vehicle 12 is a boom 16 which is adapted to be raised and lowered by means of a hydraulic cylinder 18. Pivotally mounted to boom 16 is a frame assembly 20. Frame assembly 20 pivots about axis 22, and this pivotal movement is controlled by means of a second hydraulic cylinder 24. Rotatably mounted to frame assembly 20 is a wheel assembly 26. Also mounted to frame assembly 20 are a horizontally disposed conveyor assembly 28 and a shoe assembly 30.

Wheel assembly 26 comprises a pair of circular rims 32 which are rotatably mounted to frame assembly 20 by means of two stationary rotatable truck or dolly wheels 34, and a third movable truck or dolly wheel 36. Stationary dolly wheels 34 are mounted to a frame member 38 of frame assembly 20 by means of brackets 40. Movable dolly wheel 36 is mounted to frame member 38 by means of a pair of truss members 40, 42.

Truss member 42 is pivotally mounted at one of its ends to a bracket 44 attached to frame member 38 for pivotal movement about axis 46. The other end of truss member 42 is fixed to a collar 48 (FIG. 3) which houses an axle 50 which in turn is mounted to movable wheel 36. Wheels 36 and axle 50 rotate within collar 48.

Attached to collar 48 and extending upwardly therefrom is the lower end 52 of truss member 40. Lower end 52 of truss member 40 is telescopically received within an upper end 54 of truss member 40 so as to permit longitudinal telescopic movement with respect to upper and lowermembers 52, 54. Upper member 54 is pivotally mounted to frame member 38 by means of a bracket 56 for pivotal movement about axis 58.

Mounted within upper and lower ends 42, 54 of truss member 40 is an extensible hydraulic cylinder 60 having an extensible rod 62. Rod 62 is attached to lower member 52 and cylinder 60 is attached at the opposite end thereof to upper member 54. Thus, extension and retraction of cylinder 60 and rod 62 causes extension and retraction of upper and lower members 52, 54 with respect to one another.

Figure 3:
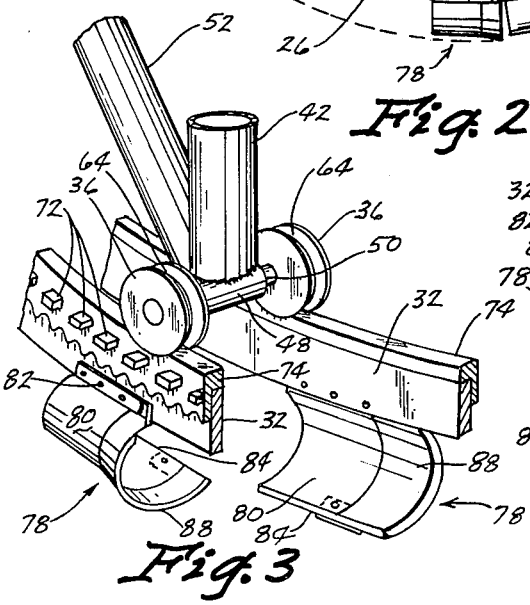
FIG. 3 is a partial perspective view of the rims and the wheel dollies which engage the rims.

Referring to FIG. 3, movable dollies 36 each include an annular groove 64 adapted to retentively embrace the inner annular margins of rims 32. Dollies 34 are of identical construction and also retentively engage the inner margins of rims 32.

Rims 32 are rotated by means of a system of gears and chains 66, 68, 70 which ultimately drive a planetary gear (not shown) within frame assembly 20, and this planetary gear is meshed with a plurality of cogs 72 protruding from rims 32. Rotation of the gear system causes the planetary gear to rotate and because of its meshing relationship with cog 72, rims 32 are rotated. As shown in FIG. 3, the inner annular margins 74 of rims 32 are provided with a special hardened surface to minimize wear between the rolling engagement of dollies 34, 36 and the inner margins of rims 32. However, a certain amount of wear ultimately occurs, and this results in a loosening or slacking of the retentive engagement between the dollies and the rims. When this occurs, the operator actuates hydraulic cylinder 60 by connecting a hydraulic fluid system to valves 76. Actuation of cylinder 60 causes extension of telescopic members 52, 54 and forces movable dolly 36 outwardly, thereby increasing the pressure between dollies 34, 36 and the inner margins of rim 32. As wear occurs, this adjustment must be made periodically to insure that the cutter continues to excavate at the original set cutting depth.

While truss member 40 is shown to be telescopic and truss member 42 is shown to be of fixed length, these two members may be reversed so that truss member 42 is telescopic and truss member 40 is of fixed length. Furthermore, the present concept may be equally adapted to a chain drive system which utilizes only two dolly wheels. In such a system, the chain is trained around the two dolly wheels, and one of the wheels is movably mounted with respect to the other. The movable mounting is accomplished by means of truss members 40, 42, and extension of the extensible member 40 causes the movable dolly to move further away from the fixed dolly, thereby increasing the tension between the dollies and the chain.

Figure 4:
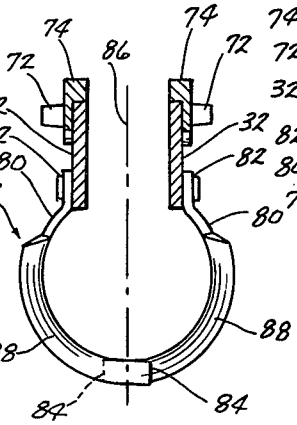
FIGS. 4 and 5 are sectional views taken along lines 4 and 5 of FIG. 2, respectively.
Figure 5:
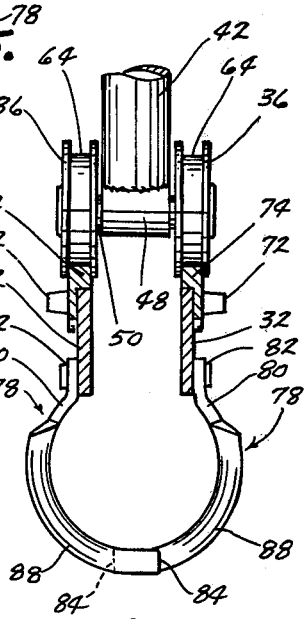
Figure 6:
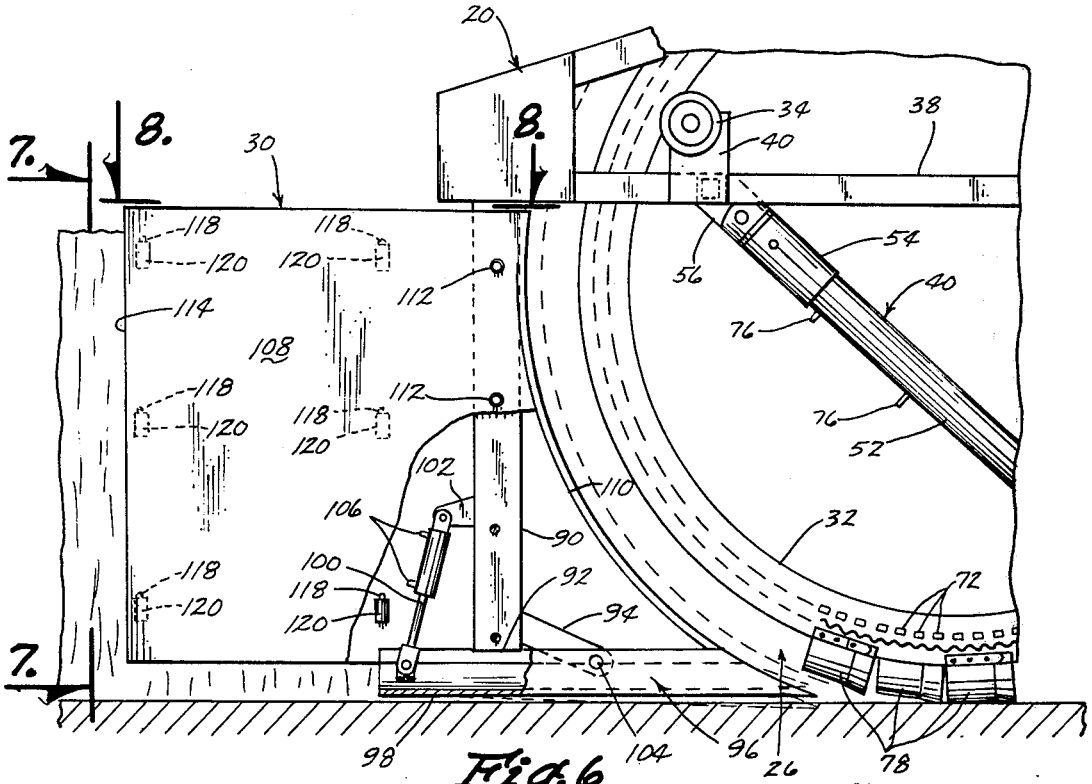
FIG. 6 is a partial elevational view of the shoe assembly of the present invention.
Figure 7:
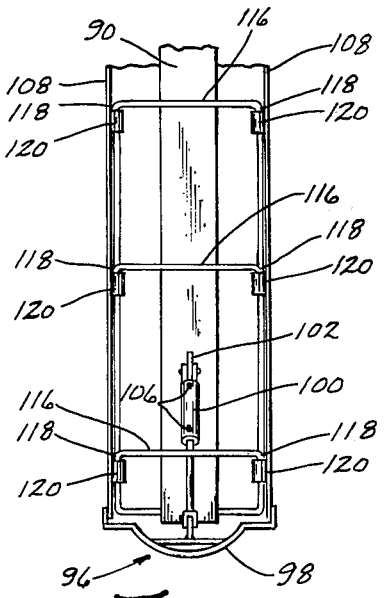
FIGS. 7 and 8 are sectional views taken along lines 7 and 8 of FIG. 6.

Mounted on the exterior peripheral edges of annular rims 32 are a plurality of excavating members 78. Each member 78 includes an arcuate plate 80 which has an upper flange 82 rigidly attached to the peripheral edge of rim 32. Plate 80 in cross section includes a partial circular configuration which terminates at a lower end 84 (FIGS. 4 and 5), located slightly over the center line 86 of the trench to be dug. Mounted on the leading edge of arcuate plate 80 is a tapered cutting edge 88 adapted to engage the earth and excavate the trench.

Figure 2:
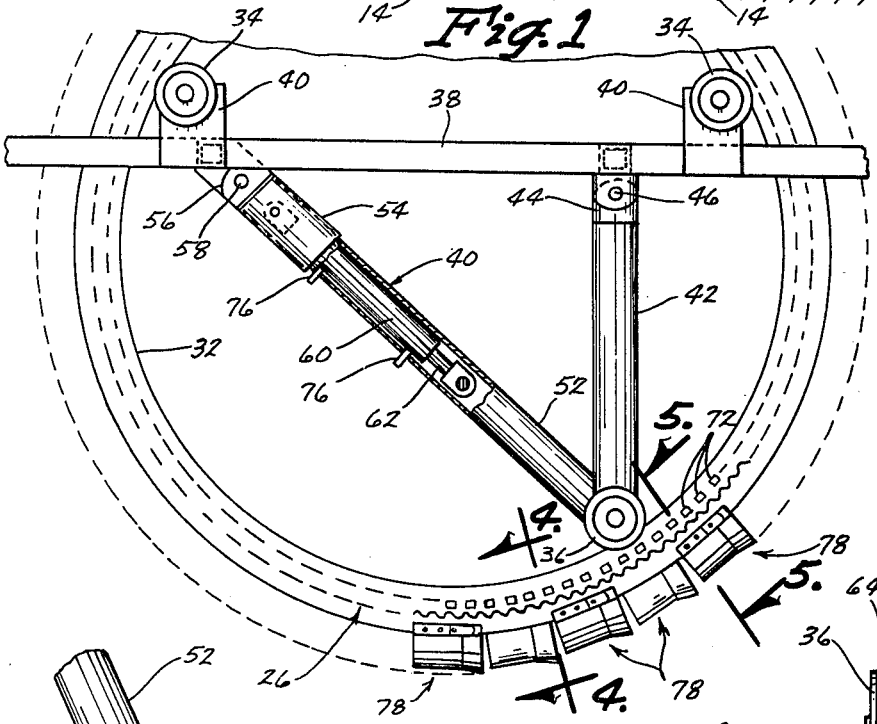
FIG. 2 is an enlarged partial view of the rotating rims, illustrating the take-up mechanism for taking up slack resulting from wear of the inner margins of the rims.

As can be seen in FIGS. 2–5, half of the excavating members face in one direction and the other half of the excavating members face in the opposite direction with the lower tips 84 of the two sets of excavating members overlapping slightly. The excavating members of one rim 32 are circumferentially offset with respect to the excavating members of the other rim 32 as shown in FIGS. 2 and 3, so that they each encounter the bottom of the trench at different sequential times. The advantage of this arrangement is that the excavating members encounter a lesser resistance at the bottom of the trench during the excavating operation due to the fact that they excavate only half of the trench cross-sectional configuration at a time whereas in previous devices, the excavating buckets cut the entire cross-sectional pattern of the trench and encountered substantially greater resistance during the cutting operation.

As the excavating members 78 progress to the top of the circle, they engage a scraping device (not shown) within the frame of frame assembly 20 which scrapes the contents of the excavating members and causes the contents to fall on conveyor assembly 28 and be carried laterally away from the trench. These scraping members are well known in the art, and consequently are not shown in the drawings. However, the fact that each excavating member includes only a half of the cross-sectional configuration of the trench, there is considerably less resistance to the scraping tools and the excavating members are cleaned more easily. Furthermore, the cleaning device forces the contents out of the excavating members with no resistance being placed directly opposite the excavating member. As the contents are ejected, they fall directly onto the conveying assembly 28.

Referring to FIGS. 6–9 a vertical shoe post 90 is rigidly secured at its upper end to the rearward end of frame assembly 20, and extends downwardly therefrom to a lower end 92 located slightly above the lower edge of the lostmost excavating member 78. Extending outwardly from the lower end 92 of shoe post 90 is a stub member 94. Pivotally mounted to stub member 94 for pivotal movement about a horizontal axis, is an enlongated shoe member 96. Shoe member 96 includes a rounded bottom 98 (FIG. 7), adapted to slide along the bottom of the trench being excavated by the machine of the present invention. Pivotally secured to the rearward end of shoe 96, is an extensible hydraulic cylinder 100, and the opposite end of cylinder 100 is pivotally secured to an ear flange 102 extending from and attached to shoe post 90. Extension and retraction of hydraulic cylinder 100 causes shoe 96 to pivot about its horizontal axis 104 so as to change the horizontal disposition of shoe 96. Hydraulic cylinder 100 includes a pair of valves 106 which are easily accessible when the machine is in the ground and operating. This provides the operator with a convenient and time saving method of adjustment. The adjustment can be made while the machine is sitting or operating. The adjustment is needed as varying soil conditions are trenched, because varying soils have different scour characteristics. In normal operations, the leading edge of the shoe should be adjusted in the pitch-up attitude approximately ¾ of an inch above the rearward end thereof.

Figure 8:
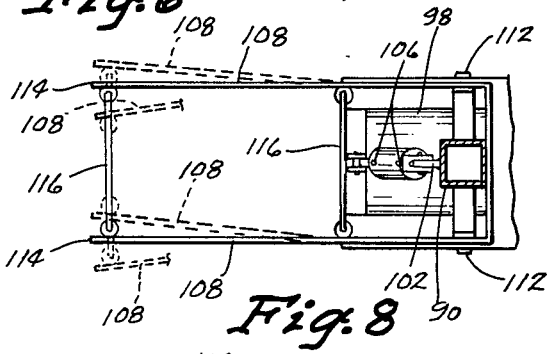

Also connected to vertical shoe post 90 are a pair of spaced apart shoe plates 108. Shoe plates 108 each include an arcuate forward edge 110 which is concentric to and spaced slightly outwardly from the outer peripheral edges of rims 32. Each plate 108 is bolted to vertical shoe post 90 by bolts 112, and extends rearwardly therefrom to rearward trailing edges 114. The spaced relationship between plates 108 is maintained by a plurality of cross members 116 each of which includes at its opposite ends a downwardly projecting hook portion 118 which is rotatably journaled for rotation about a vertical axis within the vertically disposed collar 120 mounted on the inwardly presented surfaces of plates 108. The effect of this configuration is that the rearward ends of plates 108 are laterally flexible, as illustrated in FIG. 8, but cross members 116 maintain the parallel relationship of the two plate members to one another.

Figure 9:
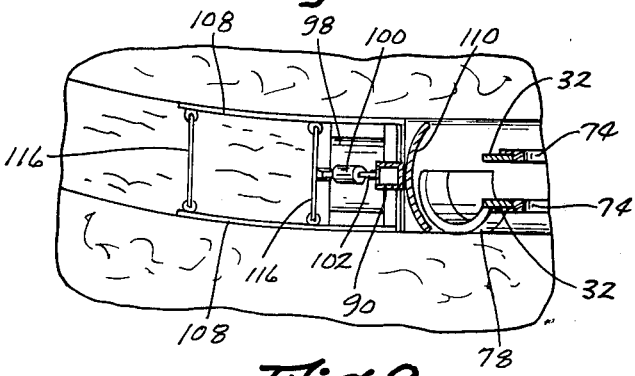
FIG. 9 is a view similar to FIG. 8 illustrating the lateral flexing of the shoe assembly during excavation of a trench.

In operation, as the trenching device commences digging the trench, plates 108 trail rearwardly therefrom and prevent a cave-in of the lateral walls of the trench. However, as shown in FIG. 9, as the trenching device turns to create a curved trench, the rearward end of plates 108 deflect laterally so as to permit the turning action. The rotational mounting of cross members 116 contribute substantially to the ability of these plate members to deflect laterally.

Thus, it can be seen that the device accomplishes at least all of its stated objectives. The extensible characteristics of truss member 40 permits dolly 36 to be moved radially outwardly to take up the wear and slack between the dollies and the inner margins of the rims. The excavating blades of the present invention may be cleaned easily, and minimize resistance during the cleaning action by virtue of the fact that there is no resistance at one side of the excavating member. The shoe assembly of the present invention permits adjustment of the shoe angle to accommodate soils of varying scour characteristics, and also the lateral deflectability of the shoe plates permits the excavating member to turn as it is excavating the trench. The device is simple in construction, economical to manufacture, and durable in use.

What is claimed is:

1. A trench excavating device for excavating a trench having a bottom surface and two sidewalls extending upwardly from the opposite sides of said bottom wall; said device comprising:

a support frame;

a movable member having a continuous outer peripheral edge;

mounting means movably mounting said movable member to said frame for causing said outer peripheral edge to move in a continuous enclosed path;

power means for causing movement of said peripheral edge in said continuous path;

elevating means connected to said frame for causing raising and lowering of said movable member with respect to the ground;

a plurality of excavating members connected adjacent said peripheral edge of said movable member in circumferentially displaced relation with one another for engaging said ground to form said bottom surface and said sidewalls of said trench;

a first group of said excavating members each having a blade commencing adjacent one of said trench sidewalls and extending towards the other of said side walls to terminate at a blade tip;

a second group of said excavating members each having a blade commencing adjacent the other of said trench sidewalls and extending towards the one sidewall to terminate at a blade tip.

each of said blades of said excavating members comprising an arcuate plate having a leading end edge and a trailing end edge, a cutting member attached to said leading edge of said arcuate plate and extending axially and radially outwardly with respect to said arcuate surface of said plate, said cutting member having a cutting edge lying in a plane normal to the longitudinal axis of said arcuate plate;

each of said arcuate plates having in cross section a partial circular configuration which is uniform in cross sectional size and shape along the length thereof, said trailing edge of said arcuate plate being free from radially inwardly extending protrusions, said blade tips of said first and second excavating members overlapping one another when viewed in a cross section taken transversely with respect to said trench, said circular configuration of said first members being continuous with said circular configuration of said second members at the point of overlapping.

* * * * *